US010494236B2

(12) United States Patent
Brzoska et al.

(10) Patent No.: US 10,494,236 B2
(45) Date of Patent: Dec. 3, 2019

(54) TELESCOPIC BOOM AND MOBILE CRANE

(71) Applicant: Liebherr-Werk Ehingen GmbH, Ehingen (DE)

(72) Inventors: Sebastian Brzoska, Ehingen (DE); Mario Helbig, Unterstadion (DE)

(73) Assignee: Liebherr-Werk Ehingen GmbH, Ehingen (DE)

( * ) Notice: Subject to any disclaimer, the term of this patent is extended or adjusted under 35 U.S.C. 154(b) by 0 days.

(21) Appl. No.: 15/976,158

(22) Filed: May 10, 2018

(65) Prior Publication Data

US 2018/0327233 A1 Nov. 15, 2018

(30) Foreign Application Priority Data

May 12, 2017 (DE) ..... 10 2017 110 412

(51) Int. Cl.
*B66C 23/70* (2006.01)

(52) U.S. Cl.
CPC .... *B66C 23/701* (2013.01); *B66C 2700/0357* (2013.01)

(58) Field of Classification Search
CPC ..... B66C 23/701; B66C 23/64; B66C 2700/0357; E02F 9/125; E02F 9/0825; E02F 3/36
See application file for complete search history.

(56) References Cited

U.S. PATENT DOCUMENTS 8,297,906 B2 * 10/2012 Nabata ..... E02F 3/38 414/685
8,756,839 B2 * 6/2014 Hren ..... E02F 9/14 37/398
2003/0118432 A1 * 6/2003 Lee ..... B66C 23/64 414/722
2018/0346292 A1 * 12/2018 Kuhn ..... B66C 23/68
2019/0085533 A1 * 3/2019 Elbel ..... E02F 3/382

FOREIGN PATENT DOCUMENTS

CN 201890731 U 7/2011
JP S4933601 * 3/1974

* cited by examiner

*Primary Examiner* — Beth A Stephan
(74) *Attorney, Agent, or Firm* — Dilworth & Barrese, LLP

(57) ABSTRACT

The present invention relates to a telescopic boom having a coupling section at whose lower shell at least one luffing cylinder mount, in particular a bolt mount, is centrally provided for fastening at least one luffing cylinder, wherein at least two closed sheet metal box structures for the load transmission from the luffing cylinder mount into the structure of the telescopic boom are provided at the support metal sheets of the luffing cylinder mount.

14 Claims, 4 Drawing Sheets

TELESCOPIC BOOM AND MOBILE CRANE

BACKGROUND OF THE INVENTION

The invention relates to a telescopic boom for a crane, in particular for a mobile crane, at whose lower shell at least one luffing cylinder mount, in particular a bolt mount is centrally provided for fastening at least one luffing cylinder.

A plurality of crane models use a centrally arranged luffing cylinder that can be bolted to the coupling section of the telescopic boom via a bolt mount. The load transmission thus takes place via the bolt mount into the lower shell of the boom section, which makes a special sheet metal structure of the bolt support necessary. The illustration of FIG. 1 shows a conventional solution of the luffing cylinder mount of the prior art. The two bolt metal support sheets 2 are shown that are welded to the lower shell 7 of the coupling section 1. A comparatively wide and closed sheet metal structure 4 adjoins the supporting metal sheets 2 and consists of a top metal sheet 3 and two sides walls divided into two and having the individual elements 5, 6.

The coupling section 1 of the telescopic boom has an ovaloid profile with the semicircular lower shell 7 that can be reinforced via a plurality of stiffening U buckling braces 8. Perpendicular web regions 9 that ultimately form the connecting element between the lower shell 7 and the upper shell 10 adjoin the semicircular part of the lower shell 7. The lower shell 7 and the metal web sheets 9 can be manufactured from a curved metal sheet. Metal wing sheets 11 surround the semicircular lower shell 7 via a part region of its radius.

The disadvantage of this sheet metal structure can be illustrated using FIG. 2 that schematically shows the force flow from the luffing cylinder into the boom section during the crane work. The introduction of the center luffing cylinder force WZ takes place via the bolt of the luffing cylinder connection, shown as a dashed line 12 here, into the two bolt metal support sheets 2. The introduced force can be distributed over the paths A and B. A portion of the force flows in path A respectively to the left and right through the two-part side walls 5, 6 and via shear seams a in the direction of the stiffer sectional region, i.e. the web region 9. The rest of the force takes the direct path in path B through the single-part top metal sheet 4 via the pressure seams b into the softer sectional region, i.e. the lower shell 7. However, this has a plurality of disadvantages:

- The force flows through a large buckling field C that is not stiffened. The high sheet metal thickness of the top metal sheet 3 therefore required results in a high weight of the total structure.
- A high risk of buckling arises due to the portion of the compressive force (pressure seam/tension seam b) in the soft sectional region that acts perpendicular to the lower shell 7. The seams b additionally act as a metallurgical notch and thus further increase this risk of buckling. Ultimately, either large sheet metal thicknesses of the lower shell 7 or additional U buckling braces 8 are required.
- In addition a further disadvantage of the sheet metal construction shown results in that a sharp tip d of the box results due to the wall element 6 and due to the top metal sheet 3 that presses at points into the lower shell 7 and thereby produces an unfavorable tension peak.

SUMMARY OF THE INVENTION

A new structure for the connection of the luffing cylinder to the boom section is therefore looked for that permits an optimized force flow from the luffing cylinder into the boom system. In addition to higher load weights, advantages in the manufacture of the boom system and a weight saving should thereby be achieved.

This object is achieved by a telescopic boom in accordance with the features herein. Advantageous embodiments of the invention are also the subject herein.

It is proposed in accordance with the invention that at least two closed sheet metal box structures for the load transmission into the structure of the telescopic boom adjoin the luffing cylinder mount arranged centrally at the lower shell, in particular the bolt mount for bolting the luffing cylinder to the boom. The sheet metal box structures are here spatially separate from one another, but converge at the point of the luffing cylinder mount.

The width of the sheet metal box structures is selected as comparatively narrow with respect to the prior art. For example, the ratio between the height and width of the box section in the axial direction is in the range between 0.5 and 2, preferably between 0.5-1.5, so that the above-described disadvantages can in particular be prevented with respect to the top metal sheet. A solution is in particular of advantage in which both sheet metal box structures are configured symmetrically to one another, in particular mirrored with respect to the longitudinal boom axis.

The two sheet metal box structures extend from the luffing cylinder mount, in particular from the bolt mount, in the direction of the boom tip. The box structures, however, do not extend in parallel with the longitudinal axis of the boom, but are instead oriented slightly obliquely to the longitudinal boom axis, whereby a force transmission into stiffer sectional regions of the boom is possible, i.e. away from the lower shell in the direction of the perpendicular web regions or in the direction of the upper shell of the boom piece.

It is particularly preferred if each sheet metal box structure has two side walls, a top metal sheet, and preferably at least one terminal metal sheet. The respective side walls extend almost perpendicular from the lower shell of the coupling section. The terminal metal sheet closes the front wall of the box section disposed opposite the luffing cylinder mount. The top metal sheet lies on the side walls and on the terminal metal sheet and consequently forms the base section of the box section.

The side walls of the respective sheet metal box structures facing the center of the lower shell are called the inner walls, whereas the oppositely disposed side walls, i.e. the side walls disposed closer to the upper shell, are called the outer walls. Unlike the prior art, the tip of the sheet metal box structure tapering narrowly is prevented by means of the terminal metal sheet, whereby unwanted tension concentrations in the transition to the lower shell are effectively prevented.

It is particularly preferred if the outer side wall of the sheet metal box structure is designed in two parts or in multiple parts. Consequently, a side wall designed with multiple parts so-to-say has a plurality of wall elements that are admittedly contiguous, but do not form a continuous surface or form an angled total surface of the outer side wall. The transition between the wall elements is called an edge.

The same preferably applies to the top metal sheet of each box structure. This can also preferably be composed of a plurality of individual metal sheets, whereby the resulting top surface has one or more transition edges that are preferably angled. In contrast, the inner side wall of each sheet metal box structure can be designed in one part.

It is particularly preferred if each sheet metal box structure has at least one inner standing metal sheet, i.e. a metal sheet arranged within the box section stands perpendicular on the top metal sheet and/or on the side wall and/or on the lower shell surface. It is particularly preferred if the inner standing metal sheet is peripherally connected to the box and to the lower shell of the coupling section.

It is furthermore of advantage if the standing metal sheet is provided in the transition region between at least two side wall elements and/or two top sheet metal elements, i.e. the standing metal sheet respectively adjoins the edges of the top metal sheet or of the side walls formed by the individual elements.

The shown sheet metal structure having at least two separate meta sheet boxes has the advantage that a large proportion of the forces can thus be introduced into the stiffer sectional region of the boom coupling section and not, as in the previous solution, instead in the softer sectional region of the bottom chord. It is a further advantage that a large proportion of the force can be introduced into the structure of the boom via shear seams. Shear seams provide a load in a direction in parallel with the weld seam, while compressive seams or tension seams show a load transversely to the weld seam. This has the consequence that the thickness of the sheet metal of the lower shell can be reduced from a static viewpoint, whereby a noticeable saving in costs and weight can be achieved. U bucking braces otherwise required can possibly also be dispensed with. The introduction of the terminal metal sheet for every single sheet metal box structure furthermore alleviates the unfavorable effect of the pressing at points into the lower shell in previous solutions.

One or more U buckling braces extending in the boom direction can, however, nevertheless be arranged at the lower shell of the boom. Each sheet metal box structure preferably then comprises matching recesses for the buckling braces so that they can be at least regionally covered by the box structures. Corresponding recesses are particularly preferably present in the respective top metal sheet of the box structure.

It is furthermore expedient to provide one or more wing metal sheets oriented transversely to the longitudinal boom axis that at least partly surround the lower shell starting from the luffing cylinder mount. Such wing metal sheets prevent a lateral deformation of the boom section, in particular when the sheet metal thickness of the lower shell is reduced due to the sheet metal box structure in accordance with the invention. The surrounding of the boom section by the wing metal sheets prevents or reduces unwanted spatial deformations of the boom section.

The present invention relates, in addition to the telescopic boom in accordance with the invention, to a crane, preferably to a mobile crane, having a telescopic boom in accordance with the present invention. The same advantages and properties accordingly result for the crane as have already been shown above with reference to the telescopic boom in accordance with the invention. A repetitive description is dispensed with for this reason.

BRIEF DESCRIPTION OF THE DRAWING

Further advantages and particulars of the invention will be explained in detail with reference to an embodiment shown in the drawing.

There are shown:

FIG. 2: the solution in accordance with FIG. 1 with a force flow drawn in;

FIG. 4: a further illustration of the structure in accordance with the invention of FIG. 3 from a slightly different angle of view and with a force flow drawn in.

DESCRIPTION OF THE PREFERRED EMBODIMENTS

Figure 3:
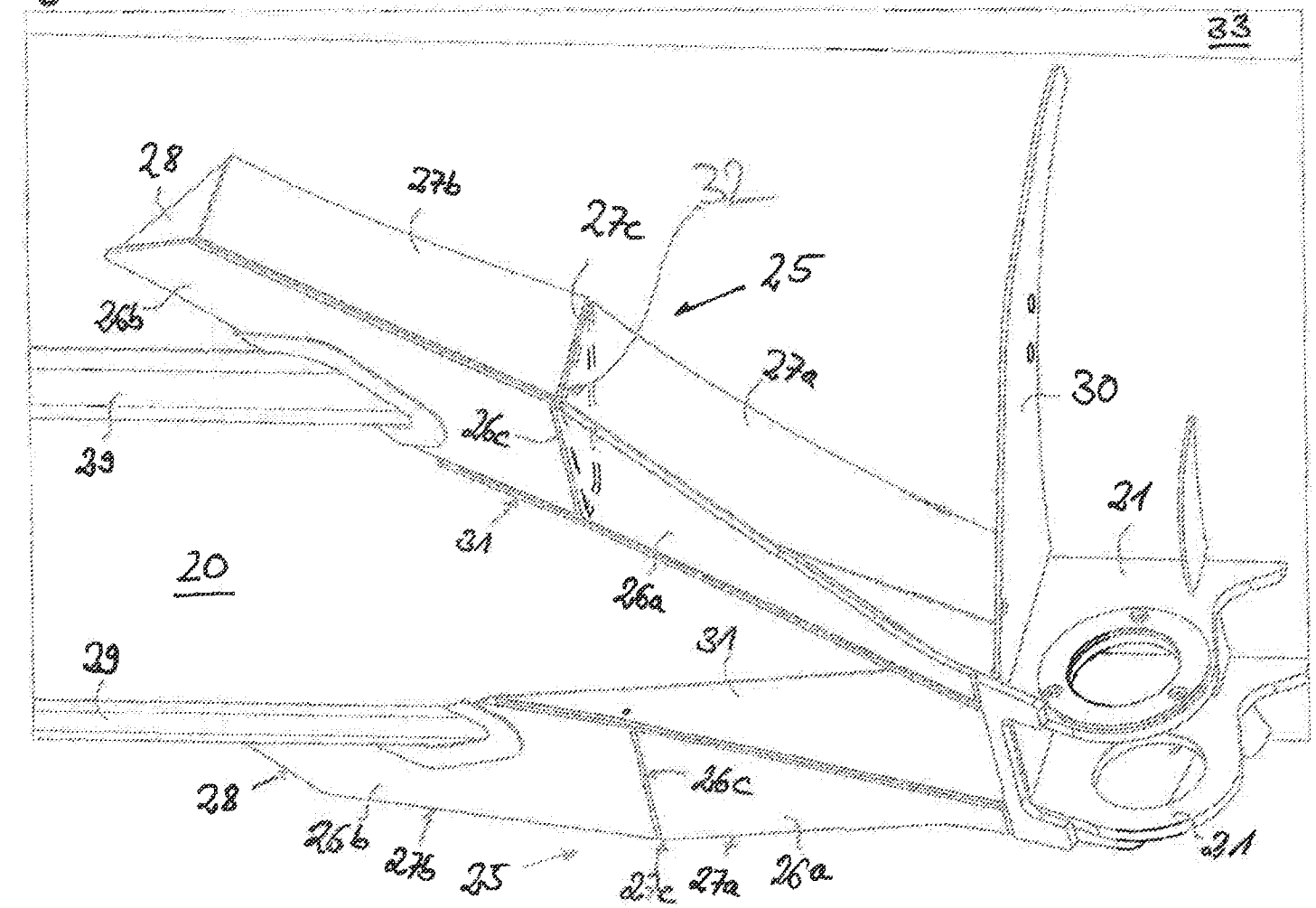
FIG. 3: the innovative structure for the luffing cylinder mount with a telescopic boom.
Figure 4:
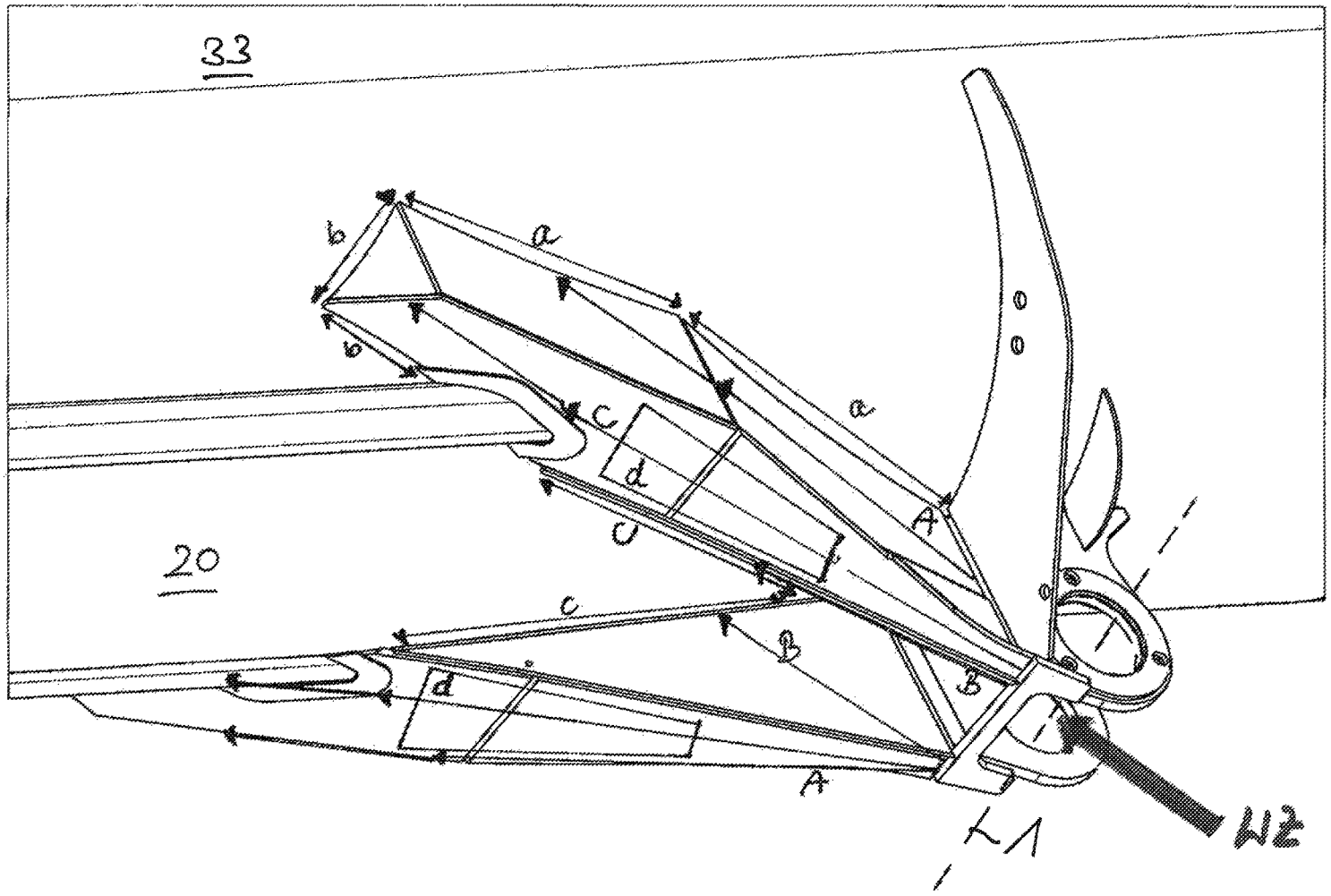

FIGS. 3 and 4 now show the innovative structure of the telescopic boom system. A part region of the lower shell 20 of the telescopic boom can be seen that has the bolt mount for the connection of the luffing cylinder. The two bolt metal support sheets 21 are provided with respective reinforcement metal sheets for the mounting of bolt of the luffing cylinder. Two narrow, closed sheet metal boxes 25 adjoin them and are designed identically with one another. Both boxes 25 each comprise a two-part top metal sheet having the individual elements 26*a*, 26*b* that are connected to one another in the edge 26*c*. The two outer side walls of the sheet metal box structures 25 are also designed in two parts having the individual elements 27*a*, 27*b* that meet one another in the edge 27*c*. A terminal metal sheet 28 is provided at the front-side end. The inner side walls 31 of the sheet metal box structures are designed in one piece.

A respective inner standing metal sheet 32 (only drawn once) is located in the interior of the two box sections 25 and is peripherally connected to the box 25 (side walls 27*a*, 27*b*, 31 and top metal sheet 26*a*, 26*b*) and to the lower shell 20. It can additionally be seen that the standing metal sheet 32 is connected to the box structure 25 exactly in the region of the edges 27*c*, 26*c*.

A plurality of stiffening U buckling braces 29 are provided on the ovaloid section of the boom, i.e., on the semicircular lower shell 20. A perpendicular web region 33 adjoins the lower shell and connects the lower shell 20 to the upper shell, not shown, of the telescopic boom.

Metal wing sheets 30 surround the semicircular lower shell 20 over a part region of its radius. FIGS. 3 and 4 only show one metal wing sheet 30; however, a metal wing sheet corresponding to the shown metal wing sheet 30 can likewise be arranged at the oppositely disposed side of the bolt metal support sheets 21 so that said metal wing sheet also at least surrounds a part portion of the radius of the lower shell 20. The selected length of the metal wing sheets 30 decisively depends on the present sheet metal thickness of the ovaloid section of the boom coupling part, in particular on the sheet metal thickness of the lower shell 20.

The optimized force flow that is possible by the new structure of the luffing cylinder mount in accordance with the invention will now be described with reference to FIG. 4. The force flow is indicated by the arrows in FIG. 4. The introduction of the central luffing cylinder force WZ takes place as in the prior art via a bolt 12 drawn as a dashed line into the two bolt metal support sheets 21 having partial metal reinforcement sheets. The introduced force is then divided over the paths A, B, and C.

A proportion of the force WZ flows over the path A respectively to the left and the right through the two-part outer side walls 27*a*, 27*b* and is transferred over the shear seams a into the lower shell 20 in the direction of the stiffer sectional region, i.e. it is transmitted into the perpendicular web region 33 adjoining the lower shell 20.

Figure 2:
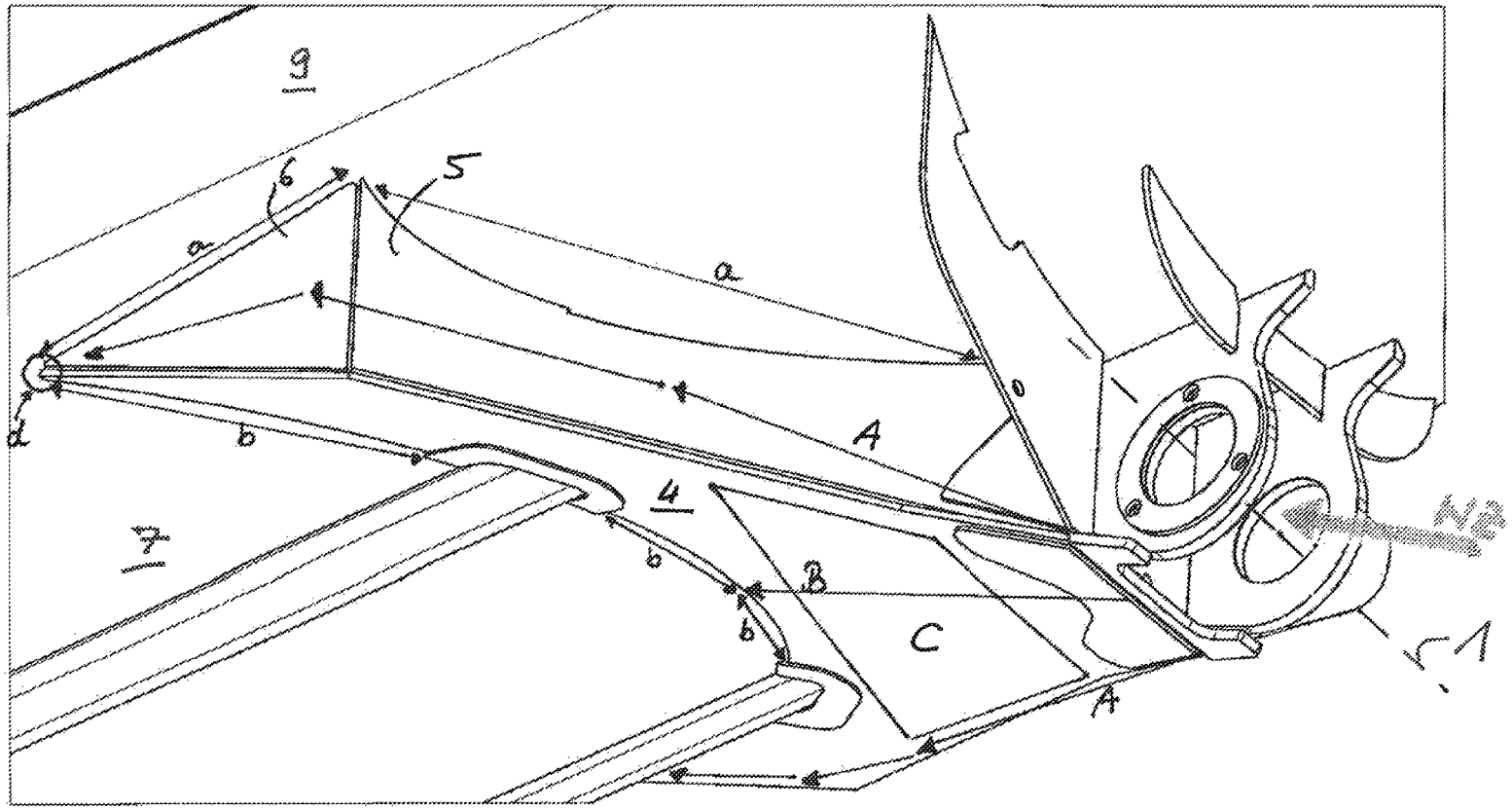
Fig. 2 PRIOR ART

A further proportion of the force flows in the path B through the single-part inner side wall 31 and over the shear seams c in the direction of the softer sectional region, i.e. into the lower shell. This is less critical than in the previous configuration of FIG. 2 since the load introduction into the boom takes place by shear over the shear seams c.

Figure 1:
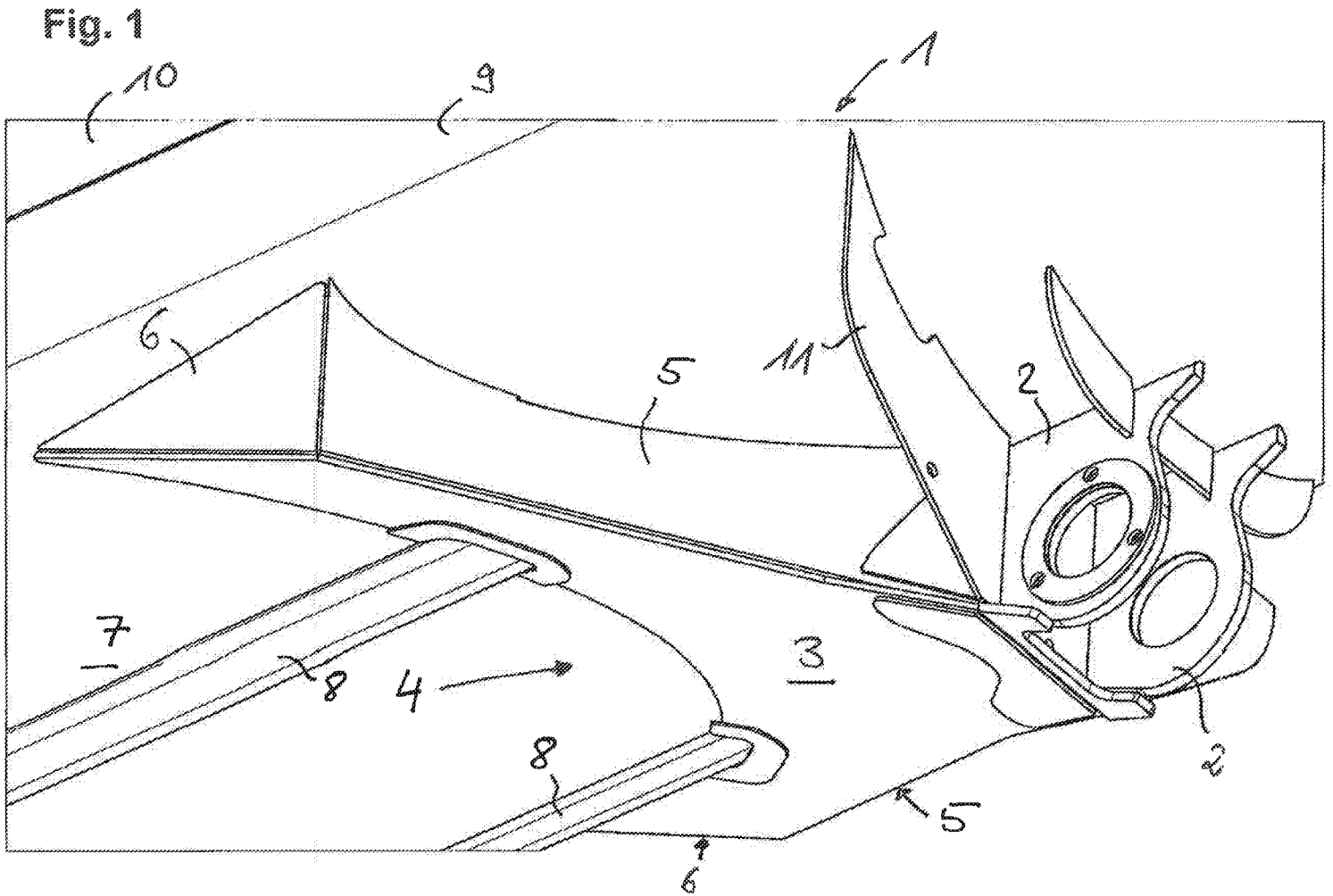
Fig. 1 PRIOR ART
FIG. 1: a luffing cylinder mount for a telescopic boom known from the prior art.

The remainder of the force flows over the path C through the two-part top metal sheet 26*a*, 26*b* over pressure seams b in the direction of the stiffer sectional region (perpendicular web region 33). The disadvantages of the previous construction are thereby avoided that the force flows through two small buckling fields d reinforced by a kink 26*c* having a kink support metal sheet 32. The sheet metal thicknesses can here be selected as smaller than the required sheet metal thickness of the top metal sheet 4 in accordance with FIGS. 1, 2 of the prior art. The number of U buckling braces 29 can also be reduced since FIG. 1, for example, requires a further buckling brace that extends between the two buckling braces 8 with an insufficient sheet metal thickness of the lower shell 7. The terminal metal sheet 28 alleviates the unfavorable effect of the pressing at points in the current solution into the lower shell 20. If the advantage of the smaller lower shell sheet metal thicknesses is implemented, this can result in increased, lateral "inflation" of the ovaloid section. This can be restricted by a greater surrounding by the wing metal sheets 30.

To summarize, it can be stated that the innovative structure permits an optimized force flow in which the force is conducted from the luffing cylinder directly in the direction of the stiffer sectional regions 33 of the boom coupling section. There is consequently a weight saving due to a plurality of effects. The lower shell 20 can possibly have a thinner design and additional U buckling braces 29 can optionally be dispensed with. The wide, thicker single-part top metal sheet in accordance with the prior art can be replaced with a total of four narrow, thinner top metal sheets 26*a*, 26*b*.

The new structure can be manufactured less expensively, in particular when U bucking braces 29 (high manufacturing costs, high costs due to welding to the lower shell 20 and a subsequent straightening work due to weld seam distortion) are dispensed with. In addition the load capacity of the crane can be increased. Due to the omission of the U buckling braces, in particular at the lowest point of the half-shell 20, the free space toward the undercarriage is increased that may be required for the motor installation.

The invention claimed is:

1. A telescopic boom having a coupling section having a lower shell and at least one luffing cylinder mount centrally provided for fastening at least one luffing cylinder to the telescopic boom, wherein two closed sheet metal box structures for load transmission from the luffing cylinder mount into the telescopic boom, adjoin respective support metal sheets of the luffing cylinder mount.

2. A telescopic boom in accordance with claim 1, wherein the sheet metal box structures are symmetrical with one another.

3. A telescopic boom in accordance with claim 1, wherein the sheet metal box structures extend from the support metal sheets in a direction of a boom tip obliquely to a longitudinal boom axis.

4. A telescopic boom in accordance with claim 1, wherein each of the sheet metal box structures has two side walls, a top metal sheet, and a terminal metal sheet.

5. A telescopic boom in accordance with claim 4, wherein an outer side wall of each of the sheet metal box structures and/or the top metal sheets of each of the sheet metal box structures is in two parts or in multiple parts.

6. A telescopic boom in accordance with claim 5, wherein an inner side wall is in one part.

7. A telescopic boom in accordance with claim 1, wherein the sheet metal box structures each have at least one inner standing metal sheet that is peripherally connected to the respective box structure and to the lower shell of the coupling section.

8. A telescopic boom in accordance with claim 7, wherein the standing metal sheet is arranged in a transition region between at least two wall elements of a two-part or multiple part outer side wall and/or of a top metal sheet.

9. A telescopic boom in accordance with claim 1, wherein the coupling section has a substantially perpendicular web region adjoining the lower shell.

10. A telescopic boom in accordance with claim 1, wherein one or more U buckling braces extending in a boom direction are arranged at the lower shell, with corresponding recesses for the buckling braces being provided in the sheet metal box structures.

11. A telescopic boom in accordance with claim 10, wherein the buckling braces are provided in a top metal sheet.

12. A telescopic boom in accordance with claim 1, wherein one or more wing metal sheets are provided that are oriented transversely to a longitudinal boom axis and that at least partly surround the lower shell starting from the mount.

13. A crane, in particular a mobile crane, having at least one telescopic boom in accordance with claim 1.

14. A telescopic boom in accordance with claim 1, wherein the at least one luffing cylinder mount is a bolt mount.

* * * * *